US009290980B2

(12) United States Patent
Kramer et al.

(10) Patent No.: US 9,290,980 B2
(45) Date of Patent: Mar. 22, 2016

(54) SLAM LATCH BOLT DAMPENER

(71) Applicant: The Boeing Company, Chicago, IL (US)

(72) Inventors: Scott A. Kramer, Everett, WA (US); Daniel Rivera, Everett, WA (US)

(73) Assignee: The Boeing Company, Chicago, IL (US)

( * ) Notice: Subject to any disclaimer, the term of this patent is extended or adjusted under 35 U.S.C. 154(b) by 144 days.

(21) Appl. No.: 13/974,513

(22) Filed: Aug. 23, 2013

(65) Prior Publication Data

US 2015/0052705 A1 Feb. 26, 2015

(51) Int. Cl.

| | |
|---|---|
| ***E05C 1/02*** | (2006.01) |
| ***E05F 5/04*** | (2006.01) |
| ***E05B 1/00*** | (2006.01) |
| ***E05B 17/00*** | (2006.01) |
| ***E05B 9/00*** | (2006.01) |

(52) U.S. Cl.

CPC ..... *E05F 5/04* (2013.01); *E05B 1/0061* (2013.01); *E05B 9/002* (2013.01); *E05B 17/0045* (2013.01); *E05F 2005/046* (2013.01); *Y10T 16/299* (2015.01)

(58) Field of Classification Search

CPC ..... E05B 83/16; E05B 1/0061; E05B 5/006; E05B 15/16; E05B 17/0045; E05C 1/10; E05C 1/085; E05C 1/12; E05C 1/14; E05C 1/145; E05C 9/002; E05C 9/046; E05F 5/02; E05F 5/027; E05F 2005/02; E05F 5/04; E05F 2005/046; Y10T 16/299

USPC ..... 292/137, 163, 169, 170, 173, 143, 292/336.3, DIG. 31

See application file for complete search history.

(56) References Cited

U.S. PATENT DOCUMENTS

| | | | | |
|---|---|---|---|---|
| 2,479,256 | A * | 8/1949 | Radcliffe | 292/165 |
| 4,358,141 | A * | 11/1982 | Hamada | E05B 85/243 292/216 |
| 4,657,206 | A * | 4/1987 | Matsumoto | E05B 17/22 292/150 |
| 4,756,564 | A * | 7/1988 | Ikeda | 292/216 |
| 6,499,775 | B2 * | 12/2002 | Fujiwara | 292/143 |
| 8,888,150 | B2 * | 11/2014 | Nagaoka | E05B 77/38 292/340 |
| 2002/0171248 | A1 * | 11/2002 | Diss et al. | 292/164 |
| 2011/0025074 | A1 * | 2/2011 | Reznar | 292/33 |

FOREIGN PATENT DOCUMENTS

DE 1553515 A1 * 1/1971

OTHER PUBLICATIONS

Sealth Aeromarine Product Catalogue, part No. SAM271, http://www.sealth.com/, copyright 2006.

* cited by examiner

*Primary Examiner* — Kristina Fulton
*Assistant Examiner* — Christine M Mills
(74) *Attorney, Agent, or Firm* — Felix L. Fischer

(57) ABSTRACT

A slam latch mechanism employs an actuation lever rotatable from a first position to a second position and having a prong extending therefrom. A bolt, resiliently retractable from an extended position with the actuation lever in the first position, has a land with a slip surface engaging the prong in the second position to retract the bolt. A dampener extends from the slip surface by a margin to engage the prong in the first position to prevent metal to metal contact by the prong and slip surface with the actuation lever in the first position.

11 Claims, 8 Drawing Sheets

FIG. 5

SLAM LATCH BOLT DAMPENER

BACKGROUND INFORMATION

1. Field

Embodiments of the disclosure relate generally to latching mechanisms and more particularly to a slam latch bolt engaging a prong of a rotating actuator with a slip surface having a resilient block at a proximal end of the slip surface extending from the slip surface to engage the prong in an unrotated position spacing the prong from the slip surface preventing metal to metal contact in the unrotated position.

2. Background

Typical "Slam Latches" currently in many products operate by controlling the actuation of the bolt or bolts in the latch by one or more prongs that extend from a rotating actuator lever into the latch body. The prongs engage and push down on a slip surface on the bolt upon rotation of the actuator lever, withdrawing the bolt from a receiver and compressing a spring underneath the bolt. Upon release of the rotating actuator lever the compressed spring urges return of the bolt to the extended position.

In the unrotated position the prong of the actuator and the slip surface on the bolt engage in a planar metal to metal contact. Closing of the door or other device in which the slam latch is employed causes the bolt to be retracted against the spring and upon alignment with the receiver, to rapidly extend into the receiver resulting in the slip surface striking the prong at the extent of travel by the bolt. This metal to metal contact may create significant wear on either or both the slip surface and prong degrading performance of the latch. Additionally, the metal to metal contact with the rapid extension of the bolt into the receiver creates undesirable noise.

It is therefore desirable to provide a slam latch which minimizes metal to metal contact in the actuating mechanism to minimize noise and wear.

SUMMARY

The embodiments described herein provide a slam latch mechanism incorporating an actuation lever rotatable from a first position to a second position and having a prong extending therefrom. A bolt, resiliently retractable from an extended position with the actuation lever in the first position, has a land with a slip surface engaging the prong in the second position to retract said bolt. A dampener extends from the slip surface by a margin to engage said prong in the first position to prevent metal to metal contact by the prong and slip surface with the actuation lever in the first position.

The embodiments provide a method for operation of a slam latch mechanism by spacing a prong on an actuation lever from a slip surface on a bolt by a margin through insertion of a dampener. The actuation lever is rotated engaging the prong on the slip surface to depress the bolt to release the bolt from a receiver. The bolt is depressed by the receiver during closure with the actuation lever in an unrotated position, spacing the prong from the slip surface and dampener. The bolt is the urged into the receiver upon alignment of the receiver and bolt. Metal to metal contact of the prong of the unrotated actuation lever and the slip surface is prevented by contact of the prong on the dampener.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a slam latch actuation mechanism having an actuating prong extending from an actuation lever and a slip surface of a land in a bolt engaged by the prong upon rotation of the actuation lever for depressing the bolt, the actuation mechanism employing a dampener to prevent metal to metal contact between prong and slip surface in the unrotated position.

Figure 1:
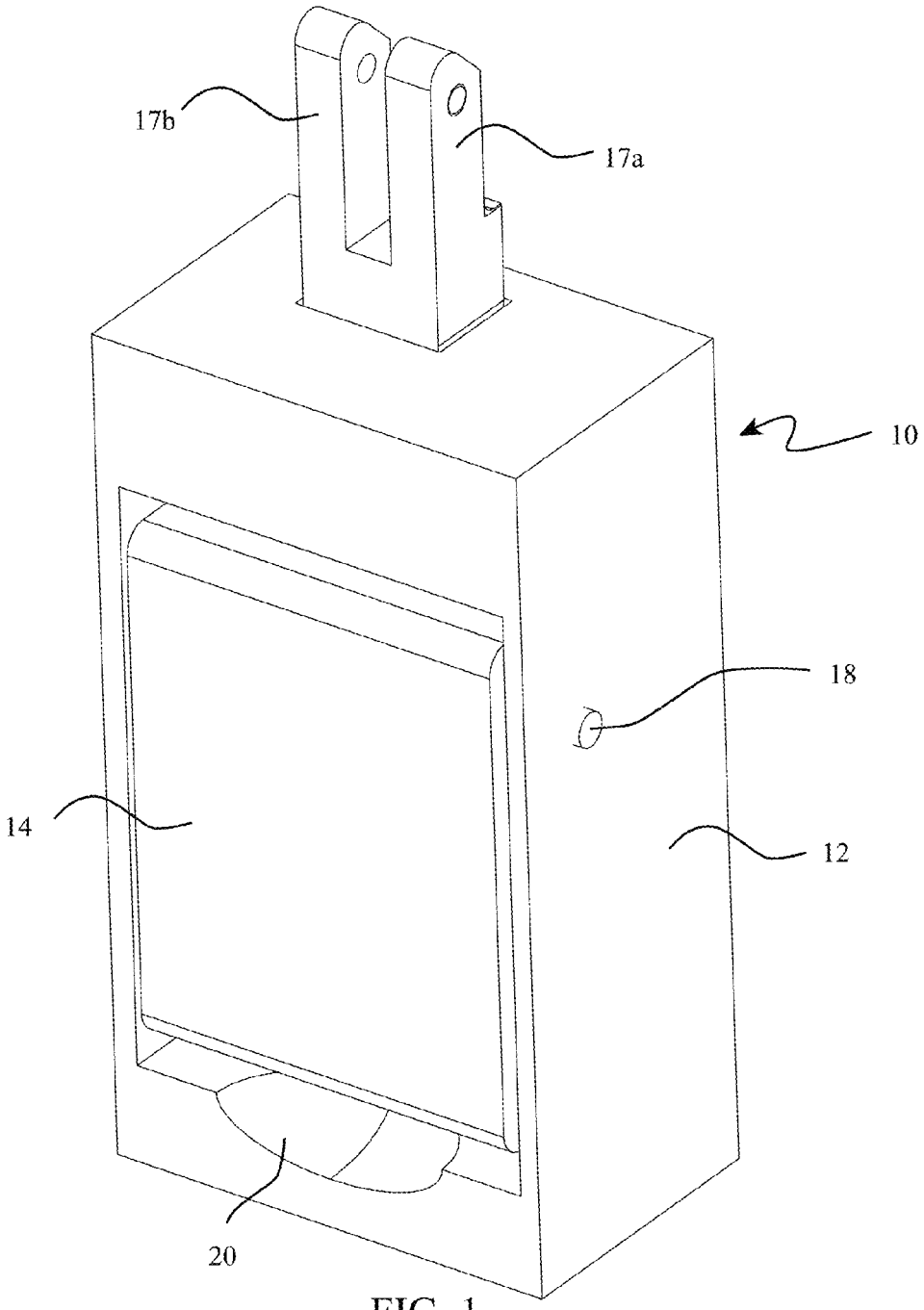
FIG. 1 is a perspective view of an example slam latch mechanism with an integrated case.

Referring to the drawings, FIG. 1 shows an exemplary embodiment of a slam latch mechanism 10 having an integrated case 12 housing an actuation lever 14 and a bolt 16. In the example embodiment, the bolt 16 has two engagement elements 17*a* and 17*b* to engage a mating receiver, as will be described in greater detail subsequently. The actuation lever is pivoted on an axle 18 supported by the case 12 for rotation from a first unactuated position to a second actuated position as will be described in greater detail subsequently. A finger cutout 20 allows the actuation lever 14 to be grasped with one or more fingers or thumb to be rotated about the axle. The case 12 is mounted in a door or other structure such as a luggage bin to secure structure in a closed position. While shown with a case for the example embodiment, the bolt and actuation lever may be integrated into the structure itself in alternative embodiments.

Figure 2A:
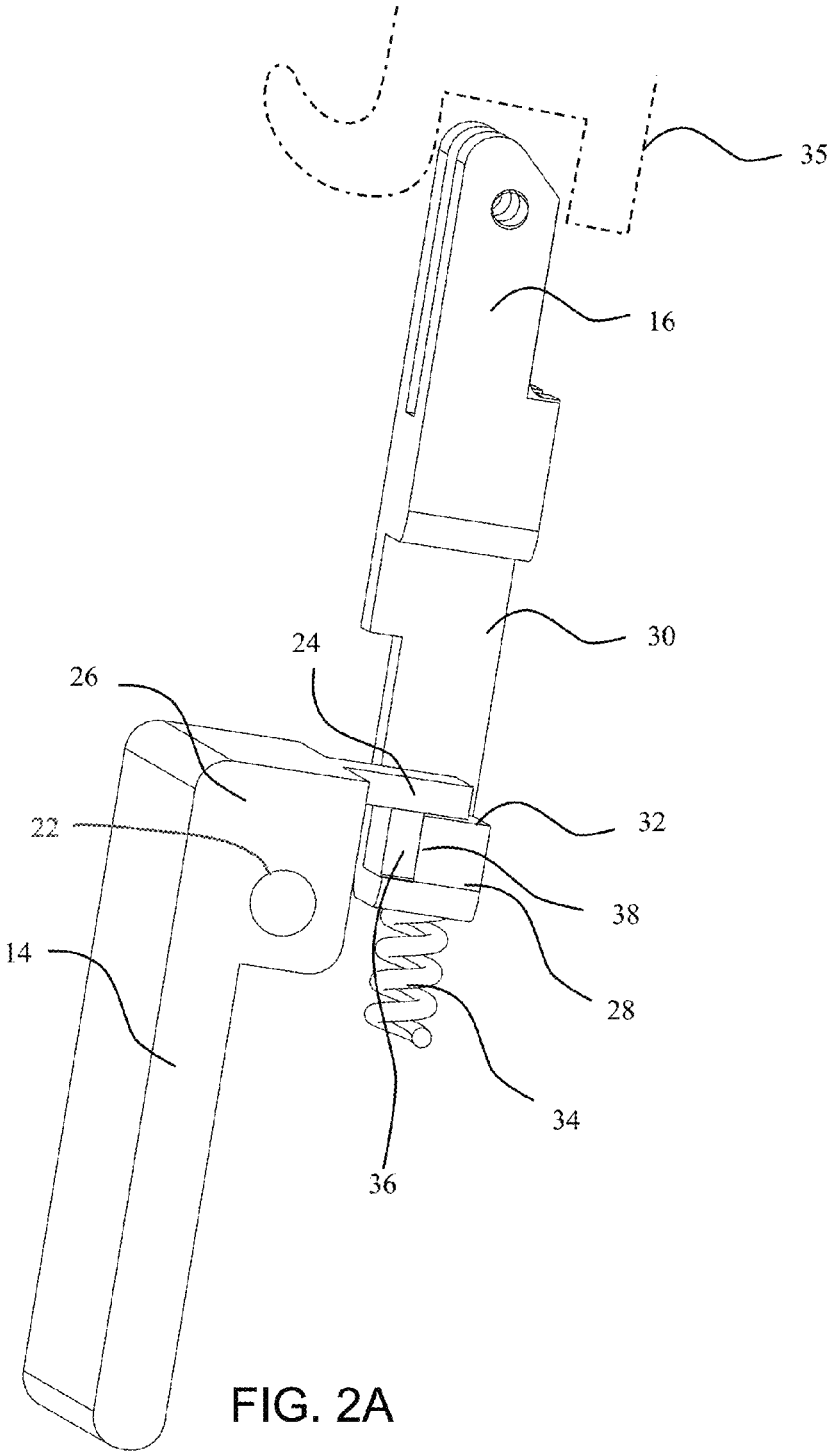
FIG. 2A is a pictorial view of the bolt and actuation lever of the slam latch mechanism with the case removed.
Figures 2B, 5:
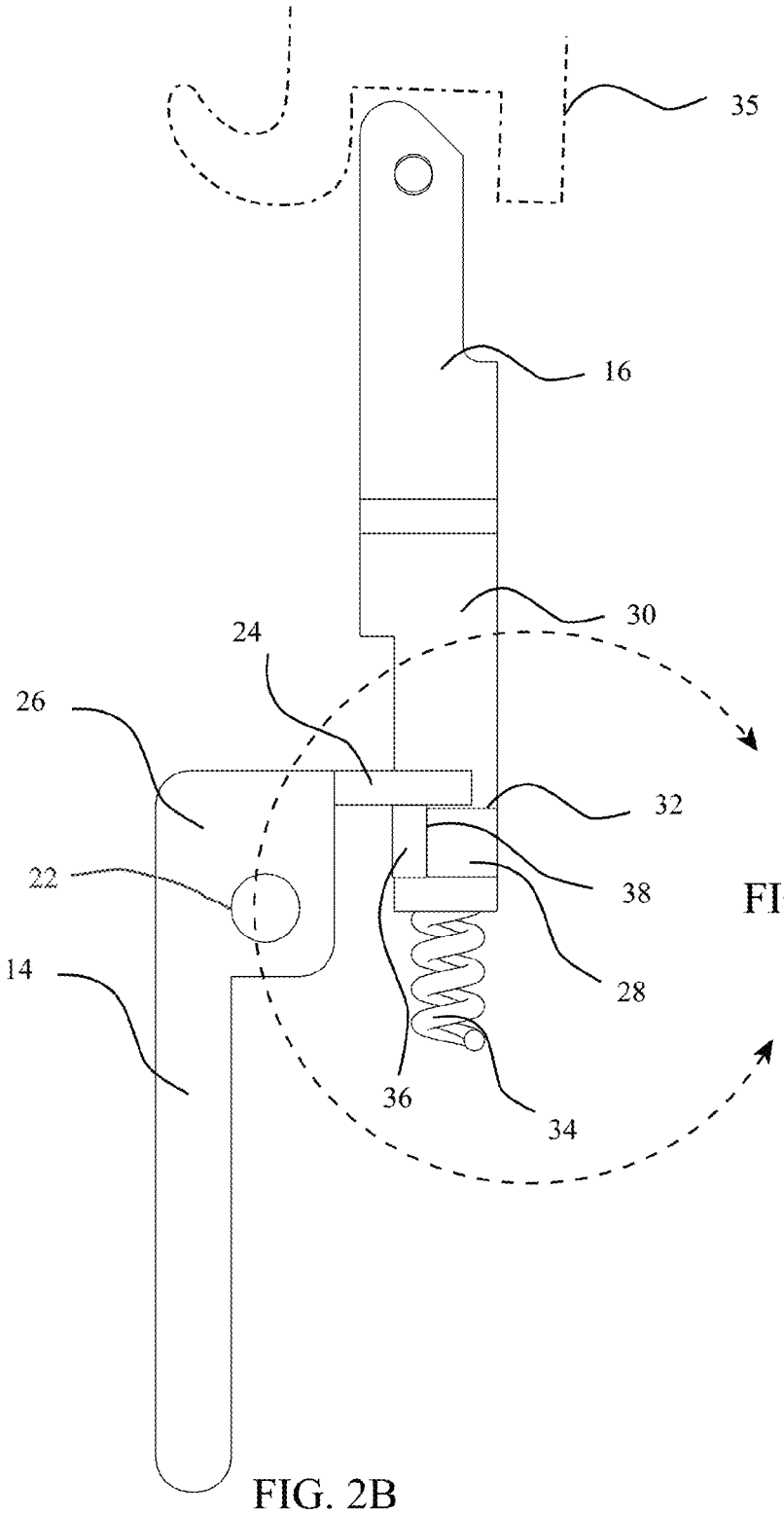
FIG. 2B is a side view of the bolt and actuation lever of the slam latch mechanism
FIG. 5 is a side detail view showing detail of the resilient dampener engaging the prong to prevent metal to metal contact of the prong and sliding surface in the unactuated position; and, FIG. 6 is a flow chart of a method for employing embodiments disclosed herein for operation of a slam latch mechanism.

The actuation lever 14 and bolt 16 are shown in detail in FIGS. 2A and 2B with the case removed for clarity. Actuation lever 14 is shown in the unrotated or unactuated first position and bolt 16 is in a corresponding extended position. The actuation lever 14 incorporates a bore 22 to receive the axle 18 for rotation. A prong 24 extends from a body 26 of the actuation lever 14. A land 28 is incorporated on the bolt 16, extending from a flange 30. A slip surface 32 on the land 28 is engaged by the prong 24 on the actuation lever to depress the bolt 16 as will be described in greater detail subsequently. For the embodiment shown, a spring 34 engages a bottom of the land 28 opposite the slip surface to be resiliently depressed upon actuation of the bolt 16 by the actuation lever. In the unactuated position, spring 34 urges the bolt 16 into a receiver 35 (shown in phantom in FIG. 2B). In prior art slam latch mechanisms, prong 24 would be in metal to metal contact with slip surface 32 on the land 28 in the unactuated position. In the present embodiments, a dampener 36 is inserted in a relief 38 in the land 28 which engages the prong 24 preventing metal to metal contact between the prong and slip surface 32, as will be described in greater detail subsequently. For example embodiments, the dampener 36 is a resilient block of silicon rubber or other sound and/or vibration-dampening material such as urethane, hard neoprene, nitrile or virgin/natural rubber.

Figure 3A:
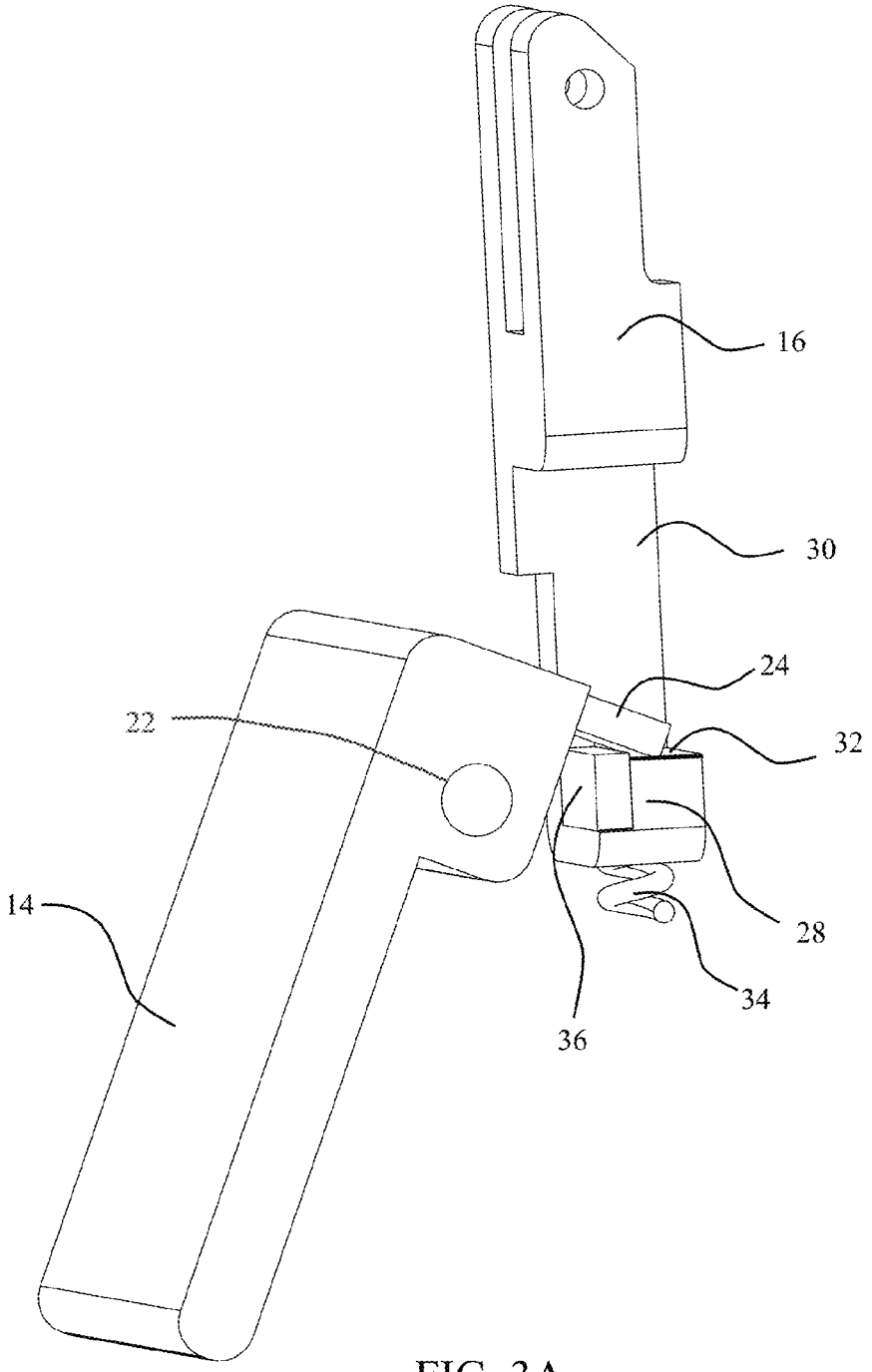
FIG. 3A is a pictorial view of the bolt and actuation lever with the actuation lever rotated engaging the prong on the sliding surface to depress the bolt.
Figure 3B:
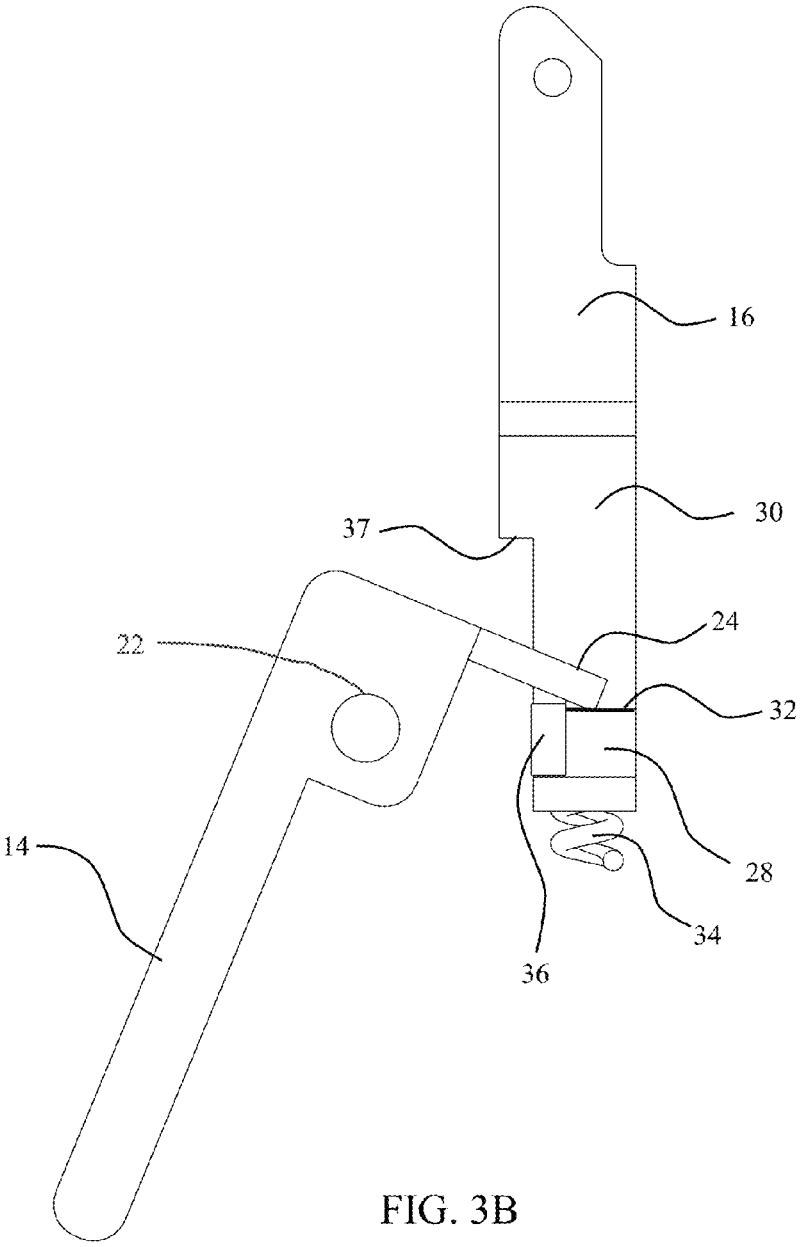
FIG. 3B is a side view of the bolt and actuation lever with the actuation lever rotated engaging the prong on the sliding surface to depress the bolt.

As shown in FIGS. 3A and 3B, actuation of the slam latch mechanism is accomplished by rotating the actuation lever 14 about bore 22 supported on axle 18 to a second rotated or actuated position. This rotation causes prong 24 to be urged against the slip surface 32 on land 28 of the bolt 16 urging the bolt downward against the resistance of spring 34 and withdrawing the bolt from the receiver 35 to a retracted position. A limiting notch 37 in the flange 30 may be employed to engage a land or similar structure in the case 12 to limit travel of the bolt 16. Normal metal to metal contact of the prong 24 and slip surface 32 allows lubricious interaction between the prong and slip surface during actuation while employing the highly durable nature those elements to prevent undesirable wear.

Figure 4:
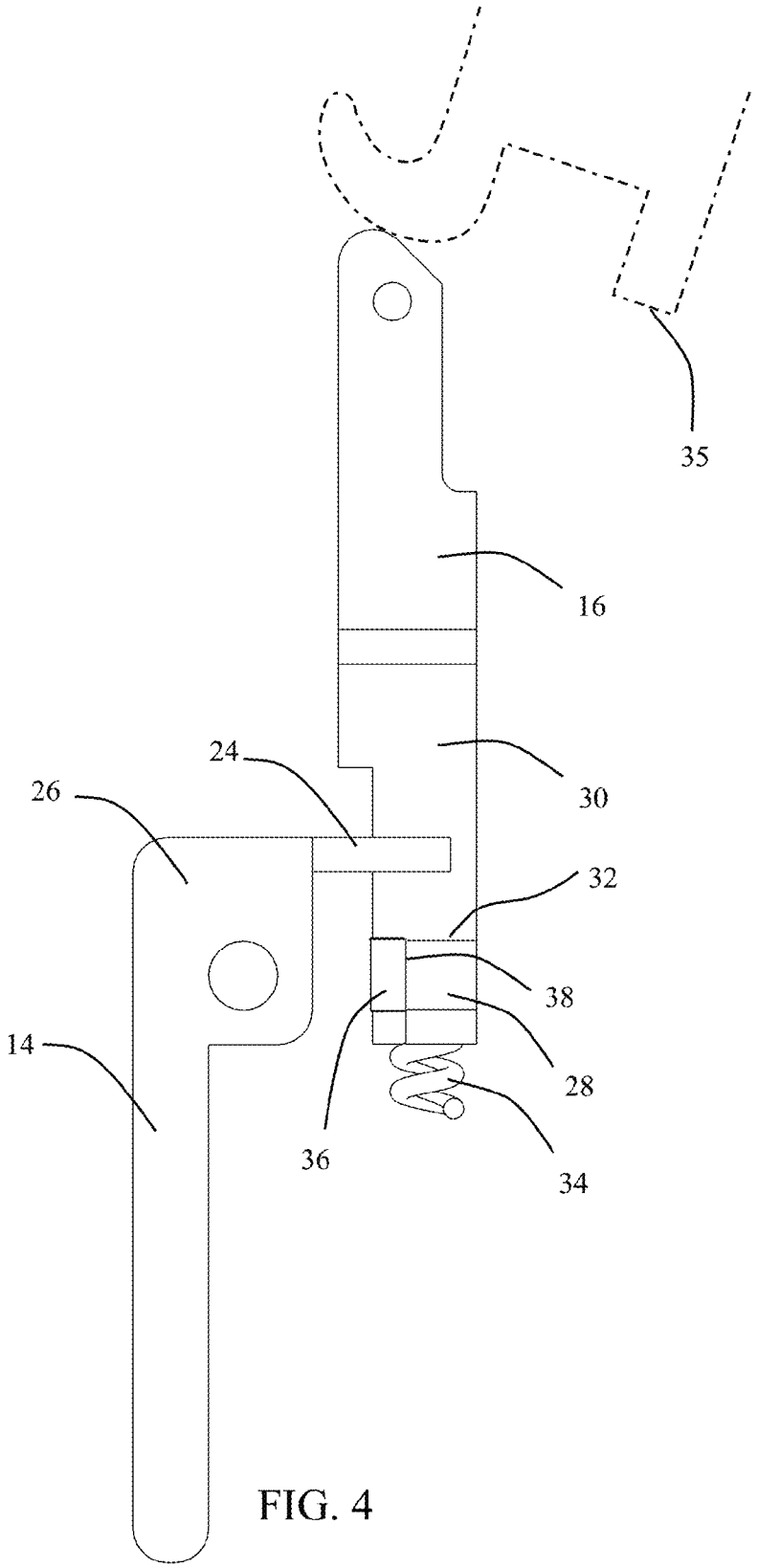
FIG. 4 is a side view of the bolt and actuation lever with the bolt in the depressed position while engaging the receiver during closure.
Figure 5:
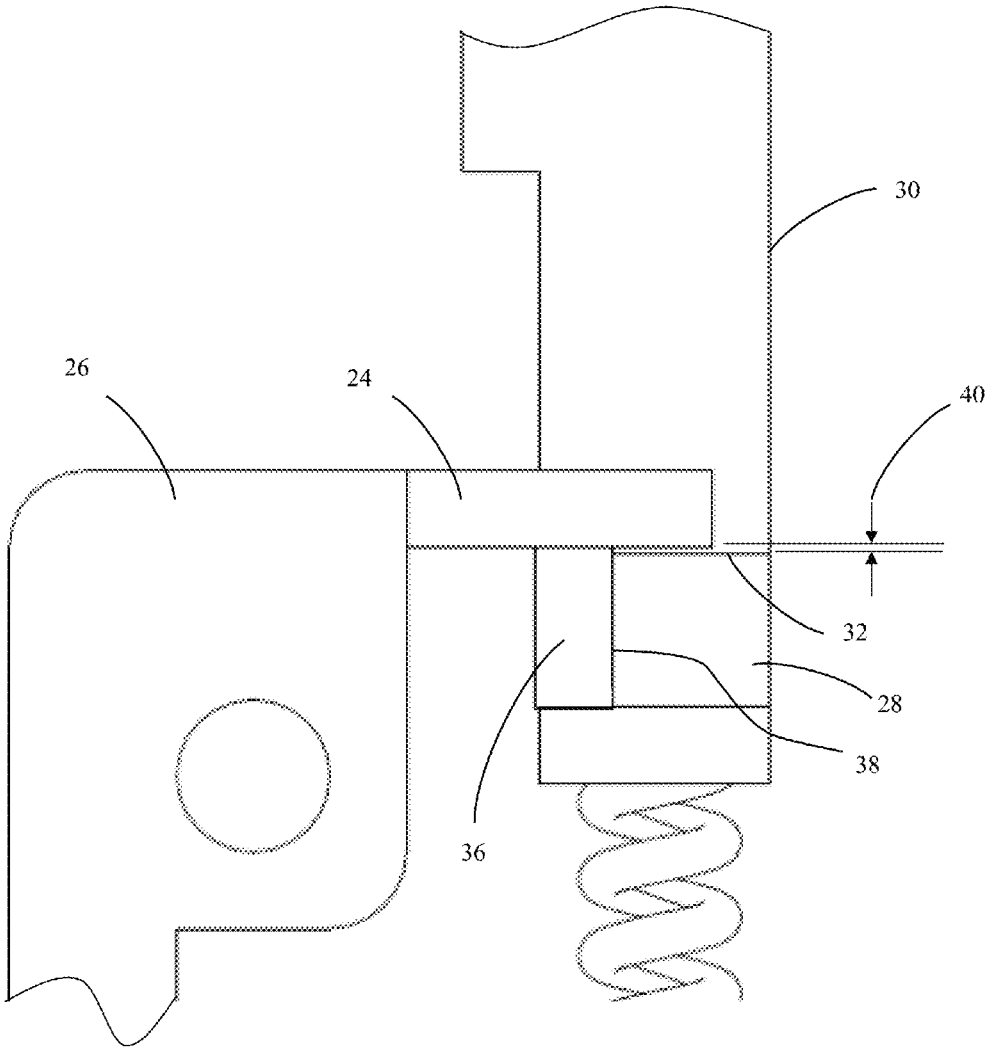

During closure of the door or other structure in which the slam latch mechanism 10 is employed, the bolt 16 is depressed by the receiver 35 as shown in FIG. 4 compressing the spring 34. This action with the actuation lever in the unrotated position spaces the prong 24 from slip surface 32. Upon alignment of the bolt 16 and receiver 35, spring 34 displaces the bolt rapidly upward into the receiver. However, as shown in FIG. 5, dampener 36 engages the prong 24 at the extent of upward travel of the bolt 16. Dampener 36 extends above the slip surface 32 by a margin 40 sufficient to prevent any metal to metal contact between the prong 24 and slip surface 32. Margin 40 is predetermined based on the compressibility of the resilient block forming the dampener 36. In example embodiments, dampener 36 has a modulus of elasticity in a range of 0.001 to 0.05 GPa and margin 40 is approximately 0.017 inch. A range of 0.005 to 0.050 inches for margin 40 provides desired operation. The margin 40 is sufficiently narrow to prevent any significant additional rotation requirement of the actuation lever 14 for necessary depression of the bolt 16 by prong 24 engaging slip surface 32. Engagement of the prong 24 by the dampener 36 during the rapid return of the bolt 16 to the extended position prevent undesirable wear of the prong 24 and slip surface 32 by avoiding any impact of those two elements. Additionally, no metal to metal noise is generated.

Figure 6:
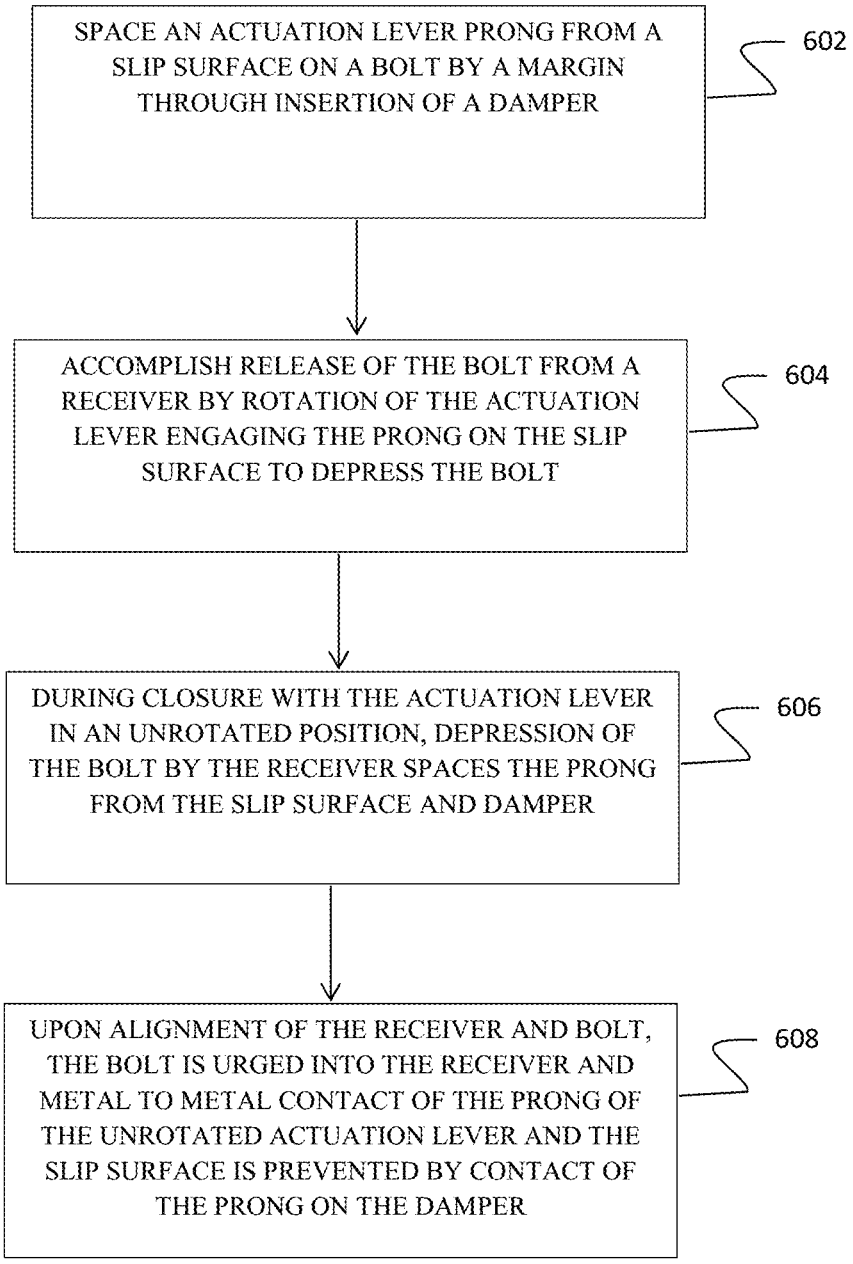

As shown in FIG. 6, the present embodiments allow slam latch mechanism operation by a method wherein an actuation lever prong is spaced from a slip surface on a bolt by a margin through insertion of a dampener, step 602, in a land relief. Selection of the material for the dampener and establishing the margin may be accomplished as previously described. Release of the bolt from a receiver is accomplished by rotation of the actuation lever engaging the prong on the slip surface to depress the bolt, step 604. During closure with the actuation lever in an unrotated position, depression of the bolt by the receiver spaces the prong from the slip surface and dampener, step 606. Upon alignment of the receiver and bolt, the bolt is urged into the receiver and metal to metal contact of the prong of the unrotated actuation lever and the slip surface is prevented by contact of the prong on the dampener, step 608.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A slam latch mechanism comprising:

an actuation lever rotatable from a first unrotated position to a second rotated position and having a prong extending therefrom;

a bolt having an extended position resiliently urged by a spring into a receiver with the actuation lever in the first position, said bolt having a land with a slip surface, said prong spaced from said slip surface in the first position and rotating to engage said slip surface with lubricious metal to metal interaction between the prong and slip surface during rotation of the actuation lever from said first position toward said second position and urging said bolt downward to retract said bolt as the actuation lever rotates to said second position; and, a dampener inserted in a relief in the land, said dampener extending above the slip surface by a margin to engage said prong in the first position preventing metal to metal contact by the prong and slip surface during rapid displacement of the bolt with the actuation lever in the first position.

2. The slam latch mechanism as defined in claim 1 further comprising the spring engages the bolt, urging said bolt into the extended position.

3. The slam latch mechanism as defined in claim 2 wherein the spring is received against the land opposite the slip surface.

4. The slam latch mechanism as defined in claim 1 wherein the dampener is a block of silicon rubber.

5. The slam latch mechanism as defined in claim 4 wherein the margin is between 0.005 and 0.050 inches.

6. The slam latch mechanism as defined in claim 1 wherein the dampener is selected from a set of vibration and/or sound dampening materials.

7. The slam latch mechanism as defined in claim 1 wherein the dampener has a modulus of elasticity of between 0.001 and 0.05 GPa.

8. A method for operation of a slam latch mechanism comprising:

spacing a prong on an actuation lever from a slip surface on a bolt by a margin with contact by a dampener when the actuation lever is in an unrotated position;

rotating the actuation lever to engage the prong on the slip surface during rotation with lubricious metal to metal interaction between the prong and slip surface and to depress the bolt to release the bolt from a receiver in a fully rotated position;

depressing the bolt by the receiver during closure with the actuation lever in an unrotated position, spacing the prong from the slip surface and dampener;

urging the bolt for rapid displacement into the receiver upon alignment of the receiver and bolt; and, preventing metal to metal contact of the prong of the unrotated actuation lever and the slip surface during the rapid displacement of the bolt by contact of the prong on the dampener.

9. The method as defined in claim 8 wherein the step of spacing a prong on an actuation lever from a slip surface on a bolt by a margin through insertion of a dampener includes inserting the dampener into a relief in a land opposite the slip surface.

10. The method as defined in claim 8 further comprising determining the margin based on modulus of elasticity of the dampener.

11. The method as defined in claim 8 further comprising selecting the dampener from the set of materials including silicon rubber, urethane, hard neoprene, nitrile or virgin/natural rubber.

* * * * *